United States Patent [19]

Labbé

[11] 3,980,087

[45] Sept. 14, 1976

[54] TOBACCO FEED SYSTEMS

[75] Inventor: Francis Auguste Maurice Labbé, Neuilly-sur-Seine, France

[73] Assignee: Molins Limited, England

[22] Filed: Nov. 22, 1974

[21] Appl. No.: 526,428

Related U.S. Application Data

[63] Continuation of Ser. No. 275,635, July 27, 1972, abandoned.

[30] Foreign Application Priority Data

Aug. 27, 1971 United Kingdom ..... 35515/71

[52] U.S. Cl. ..... 131/84 R; 131/107 B

[51] Int. Cl.[2] ..... A24C 5/18

[58] Field of Search ..... 131/84, 108, 109, 110

[56] References Cited

UNITED STATES PATENTS

| | | | |
|---|---|---|---|
| 470,269 | 3/1892 | Underwood | 131/109 UX |
| 2,629,385 | 2/1953 | Kochalski | 131/110 X |
| 2,969,104 | 1/1961 | Schubert et al. | 131/84 C UX |
| 3,074,414 | 1/1963 | Dearsley | 131/108 X |
| 3,092,117 | 6/1963 | Labbe | 131/110 |
| 3,096,770 | 7/1963 | Dearsley | 131/84 C X |
| 3,298,376 | 1/1967 | Kochalski | 131/184 C |
| 3,318,313 | 5/1967 | Rudszinat et al. | 131/84 C |
| 3,491,770 | 1/1970 | Rudszinat et al. | 131/110 X |
| 3,643,669 | 2/1972 | Korber | 131/84 C |
| 3,665,932 | 5/1972 | Goldbach | 131/110 X |

FOREIGN PATENTS OR APPLICATIONS

| | | | |
|---|---|---|---|
| 624,871 | 1/1936 | Germany | 131/108 |
| 184,314 | 4/1907 | Germany | 131/109 R |
| 443,465 | 2/1936 | United Kingdom | 131/108 |

*Primary Examiner*—Robert W. Michell
*Assistant Examiner*—V. Millin
*Attorney, Agent, or Firm*—Craig & Antonelli

[57] ABSTRACT

A cigarette making machine has a carpet-forming apparatus comprising a rotary spreading device which delivers tobacco with a winding action into an annular space between a rotary drum and a surrounding casing. Thus, a carpet is built up in the annular space and this carpet is continuously fed out of the annular space in a tangential direction. The spreading device rotates several times faster than the drum and therefore smooths or averages out the effect of variations in the physical characteristics of the tobacco. The carpet is used to form a cigarette filler stream, for example by showering the tobacco from the carpet onto a band moving transversely to the carpet, so that each section of the filler stream includes tobacco particles obtained from various positions across the width of the carpet.

42 Claims, 18 Drawing Figures

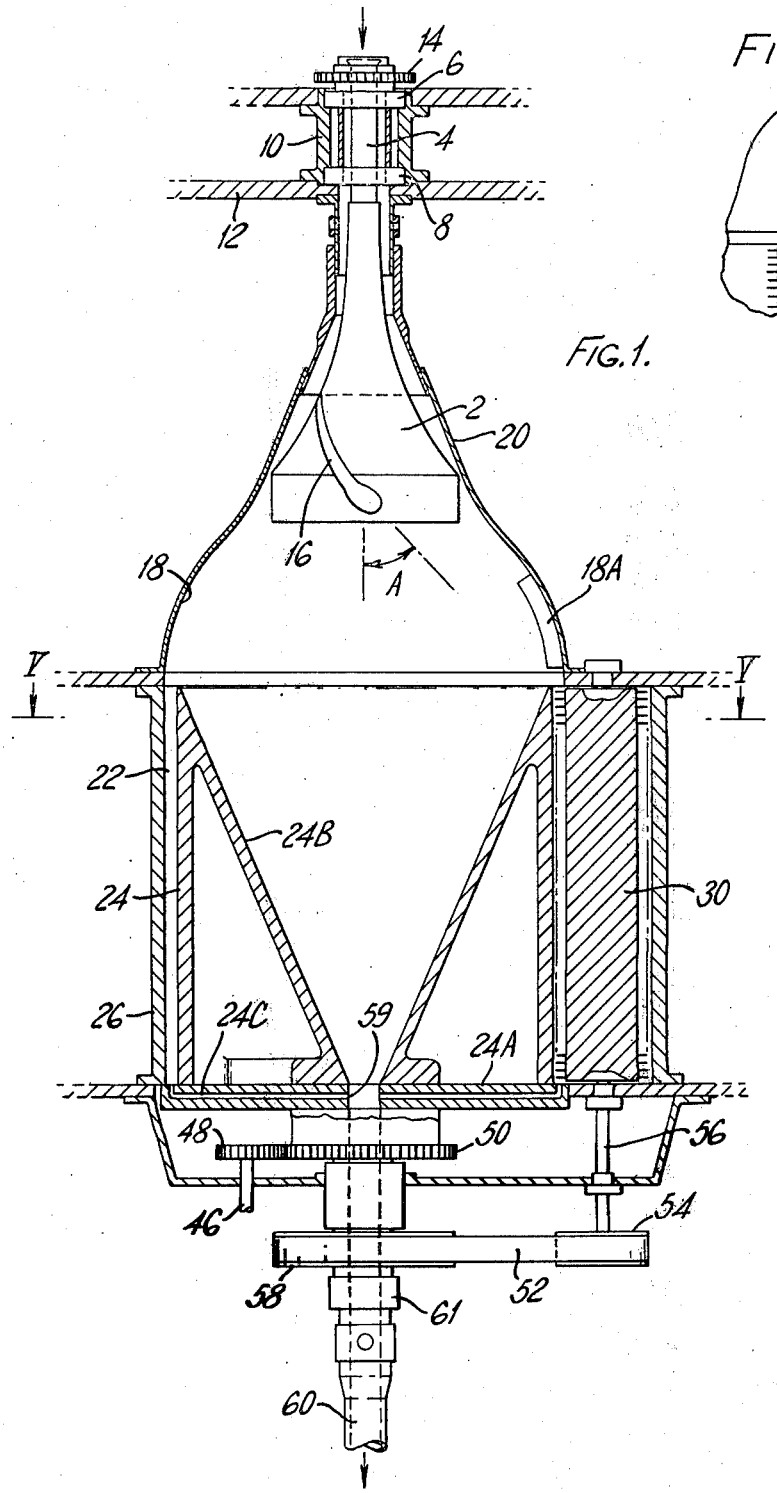
FIG. 1.
FIG. 1A
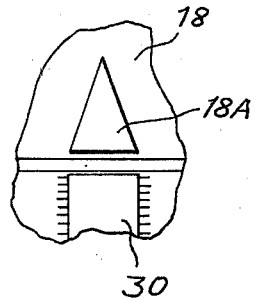

TOBACCO FEED SYSTEMS

This is a continuation of application Ser. No. 275,635, filed July 27, 1972 now abandoned. This invention is concerned mainly with tobacco feed systems and is especially concerned with tobacco feed systems for cigarette making machines.

In this specification the term "cigarette" will be used with the intention that it should be regarded as including other similar articles for smoking. The term "tobacco" will be used with the intention that it should be regarded as including any material or mixture of materials which may be used to form the filler of a cigarette or other similar article for smoking.

One aspect of this invention is concerned with rotary spreading devices for throwing tobacco, possibly with the aid of centrifugal force, into an annular space to build up a tobacco stream. Spreading devices for this purpose have already been proposed for example in U.S. Pat. Nos. 2,629,385, 2,629,386, 2,835,297 and 3,473,538.

A spreading device according to this aspect of the present invention preferably comprises a rotary member including a channel which has a tobacco inlet end on the axis of rotation of the rotary member, and an outlet end spaced from the axis of rotation, so that the tobacco is delivered from the spreading device with a winding action. That is to say, the stream of tobacco issuing from the channel of the spreading device is "wound" into the annular space, the tobacco stream built up in the annular space being composed of a number of layers produced by successive revolutions of the spreading device. The speed of rotation of the spreading device is preferably high so that the tobacco stream built up in the annular space is composed of many layers, thus giving an averaging effect in regard to variations in the quality of the tobacco.

The outlet end portion of the channel is preferably inclined backwards with respect to a radial line at the outlet end (that is, backwards in relation to the direction of motion) so that the tobacco particles leave the channel with substantially no circumferential component of motion.

The annular space into which the tobacco is thrown by the spreading device may be such as to form a circumferentially extending stream of relatively small cross-sectional dimensions, for example as described in the patents referred to above. Preferably, however, the annular space is arranged to form a tobacco carpet which is then formed into a narrow tobacco stream, for example by showering the tobacco on to a moving band in the conventional way.

The tobacco particles are preferably carried to the spreading device by air via an air separator which removes part of the air so that the tobacco particles proceed to the spreading device with only part of the volume of air (for example 10 to 20%) used to carry the tobacco towards the air separator.

Another aspect of this invention is concerned generally with forming a carpet of tobacco which can then be formed into a narrow tobacco stream, for example by showering the tobacco on to a moving band in a conventional way, or by narrowing down the carpet as it moves longitudinally, for example as described in U.S. Pat. No. 3,548,837. According to this aspect of the invention, apparatus for forming a carpet of tobacco comprises a spreading device arranged to throw particles of tobacco into an annular space between two cooperating members (preferably one within the other) of which at least one moves so that a tobacco carpet which builds up in the annular spaces is carried by the moving member towards an outlet from the annular space through which the carpet is delivered, preferably in a substantially tangential direction.

In a preferred arrangement the two cooperating members are preferably a rotary drum and a surrounding member which is stationary. Preferably both members are substantially cylindrical, but they could for example by frusto-conical. A further possibility is that they could be diabolo-shaped, the outlet from the annular space being along a straight line inclined to the axis of the drum.

The spreading device is preferably in accordance with the first aspect of this invention. In the case where the cooperating members forming the annular space comprise a substantially cylindrical drum and a surrounding member, the outlet end portion of the channel of the spreading device is preferably inclined towards the annular space, and the tobacco discharged from the spreading device is deflected into the annular space by a fixed annular deflector, for example of part-spherical shape. As an alternative the outlet end portion of the channel could be parallel to the axis of rotation of the spreading device and at a distance from the axis such that the tobacco is discharged straight into the annular space without the aid of a fixed deflector.

The speed of the spreading device is preferably much higher than that of the drum, so that any temporary change in for example the quality of the tobacco e.g.,, the proportion of long and short tobacco, is spread out over as many layers as possible of the tobacco deposited in the annular space by successive revolutions of the spreading device; in the case of a relatively short-term change in the quality of the tobacco, the effect of the high speed of rotation of the spreading device is to spread this different-quality tobacco over a substantial arc in the annular space so that the effect of its presence is less significant in any given cross-section of the carpet which emerges from the annular space. In other words, the high-speed spreading device averages out variations in the quality of the tobacco.

Different forms of spreading device can be used in carrying out the second aspect of this invention. For example, a rotary spreading device could have a number of channels each of which receives part of the tobacco flow delivered to the spreading device; the channels may be similar and may be evenly spaced round the axis of rotation, or they may be randomly placed and randomly shaped. A further alternative spreading device consists of a rotating disc on to which the tobacco particles are projected substantially along the axis of the disc, so that the particles strike the disc and are thrown outwards by centrifugal force. Another possibility is that the spreading device may comprise a passage into which the tobacco is delivered and the wall of which is formed with a number of circumferentially spaced air inlets so shaped as to admit air jets which impart to the tobacco a circumferential component of velocity, so that the tobacco is thrown outwards and passes into the annular space.

Examples of apparatus according to this invention will now be described with reference to the accompanying drawings. In these drawings:

FIG. 1 is a partly sectioned view of the main part of one apparatus;

FIG. 1A is a view of part of the apparatus of FIG. 1 as seen in the direction of the arrow 1A;

Figure 2:
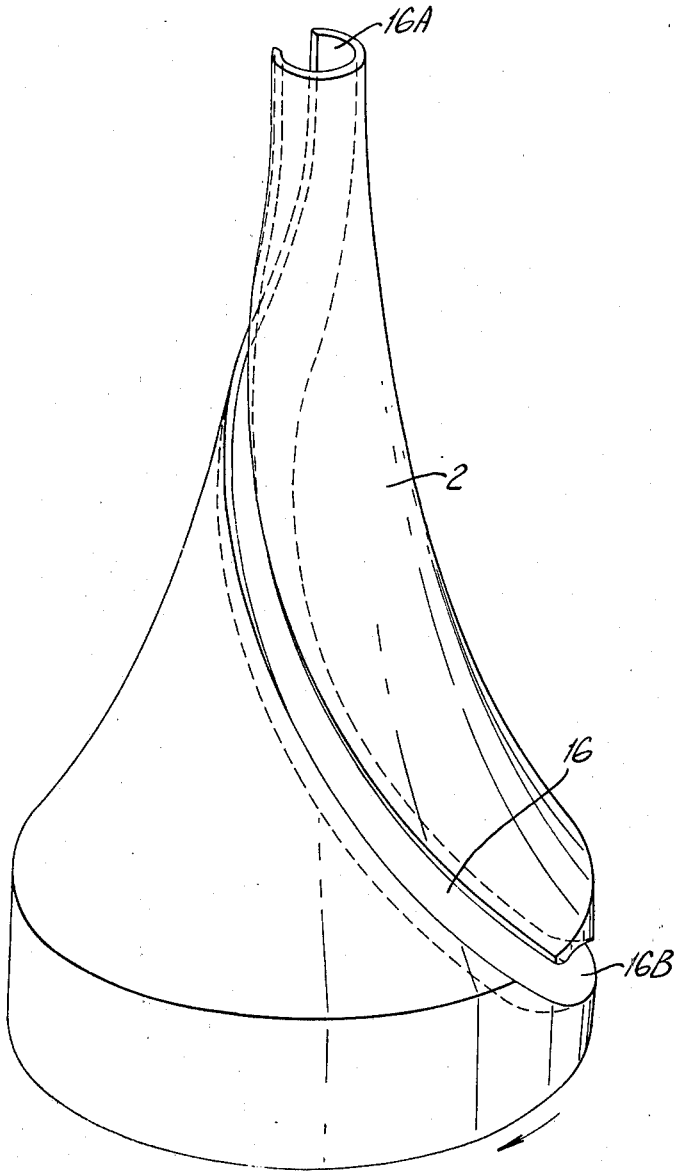
FIG. 2 is a perspective view of the spreading device in FIG. 1, but on a larger scale.

The apparatus shown in FIG. 1 includes a rotary spreading device 2 which is carried by a hollow shaft 4 mounted in ball bearings 6 and 8 in a sleeve 10 fixed to a stationary frame 12. A gear wheel 14 mounted near the end of the shaft 4 allows the shaft to be driven at a high speed, for example 1200 revolutions per minute. For convenience the apparatus will be described with the axis of the spreading device 2 vertical, but it should be understood that the axis could in principle have a different orientation, for example horizontal.

During use, a stream of tobacco is delivered through the hollow shaft 4 (for example via an air separator as will be described with reference to FIG. 5) and passes into a channel 16 formed by a groove in the spreading device 2. The velocity of the tobacco entering the spreading device may, for example, be about 21 meters/sec. As shown particularly in FIG. 2, the channel 16 has a tobacco inlet end 16A which is aligned with the axis of rotation of the spreading device. From the inlet end 16A the channel 16 extends downwards and winds around the spreading device at an ever-increasing radius so that the outlet end 16B of the channel directs the tobacco stream backwards in relation to the direction of movement of the end 16B of the channel. This backward inclination is shown as the angle A in FIG. 4, which is a plan view of the channel 16 (shown in this Figure and in FIG. 3 as a pipe, instead of as a groove). As a result of this backward inclination of the outlet end of the channel, the tobacco leaving the channel preferably has substantially no circumferential component of motion. In other words, the tobacco velocity and the angle A may be such as to cancel out the circumferential component of movement caused by rotation of the spreading device. The angle A in the example shown is 55°.

Figure 3:
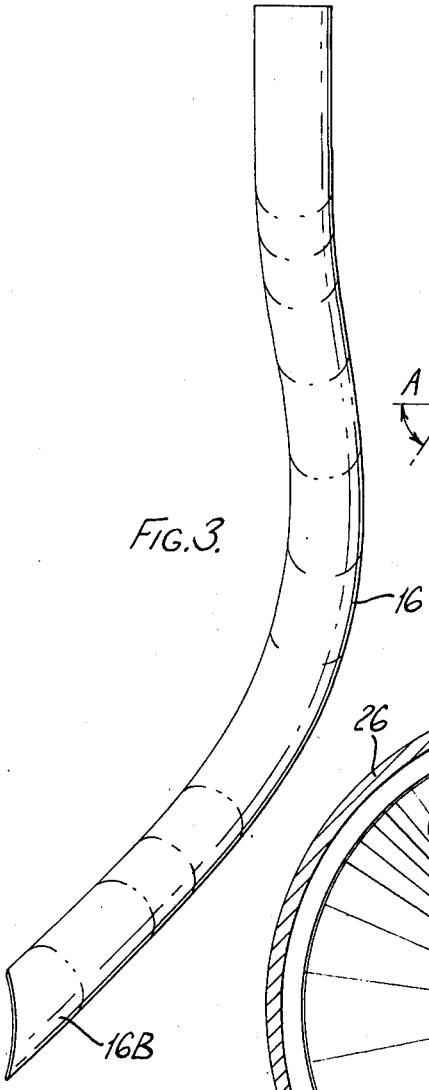
FIGS. 3 and 4 are respectively a side elevation and a plan view showing the shape of the channel in the spreading device.
Figure 4:
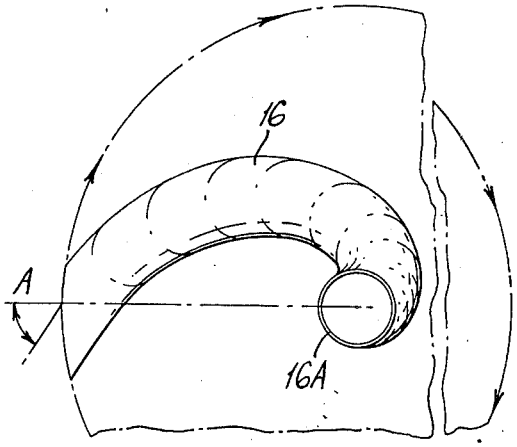

The shape of the channel 16 is like that of the channel 16′ shown in FIGS. 3 and 4; the channel 16′ is similar to the channel 16 of FIGS. 1 and 2 except that it is in the form of a pipe. It should be noted that the channel starts bending backwards immediately below the inlet end. This reduces the degree of retardation of the tobacco caused by the Coriolis effect. In fact, when the spreading device is operated in the preferred manner, the velocity of the tobacco as it leaves the outlet end of the channel 16 may be approximately equal to the velocity at which the tobacco enters the channel.

It should also be noted that the outlet end portion of the channel is inclined downwards from a radial plane (i.e. a plane normal to the axis of rotation) so that the tobacco leaving the channel of the spreading device has a downward component of motion.

The tobacco may, for example, leave the spreading device at a velocity of about 17.8 meters/sec. relative to the linear speed of the periphery of the spreading device. Taking account of the fact that this includes a circumferential velocity component which is cancelled by the rotation of the spreading device, the absolute velocity of the tobacco as it leaves the spreading device is about 12.6 meters/sec.

The tobacco projected from the spreading device is deflected by a part-spherical surface 18 in a cowl 20 (FIG. 1) into an annular space 22 between a rotary drum 24 and a stationary surrounding member 26; the space 22 has a length L, as seen in a plane containing the central axis, which is many times greater than its thickness T (see FIG. 1); the drum 24 is coaxial with the spreading device. As shown in FIG. 5, the drum 24 rotates in a counter-clockwise direction so that the carpet of tobacco which builds up in the annular space is fed out through an outlet 28 in a substantially tangential direction, being removed from the drum by a carded roller 30. A scraper 32 engages the drum and prevents any tobacco from passing the carded roller 30. Thus the roller 30, which is closely surrounded by a part 34 of a stationary casing, carries the carpet of tobacco in a clockwise direction through approximately 270° to a position in which the carpet is removed from the roller 30 by a picker roller 36. This roller 36 projects the tobacco along a slightly concave surface of a stationary part 38 of the casing. In addition a ribbed accelerator roller 40 may be included to project the tobacco at a higher speed in the direction of the arrow 42; as shown in FIG. 5, a casing part 41 lies close to the roller 40 to form an air seal.

Figure 5:
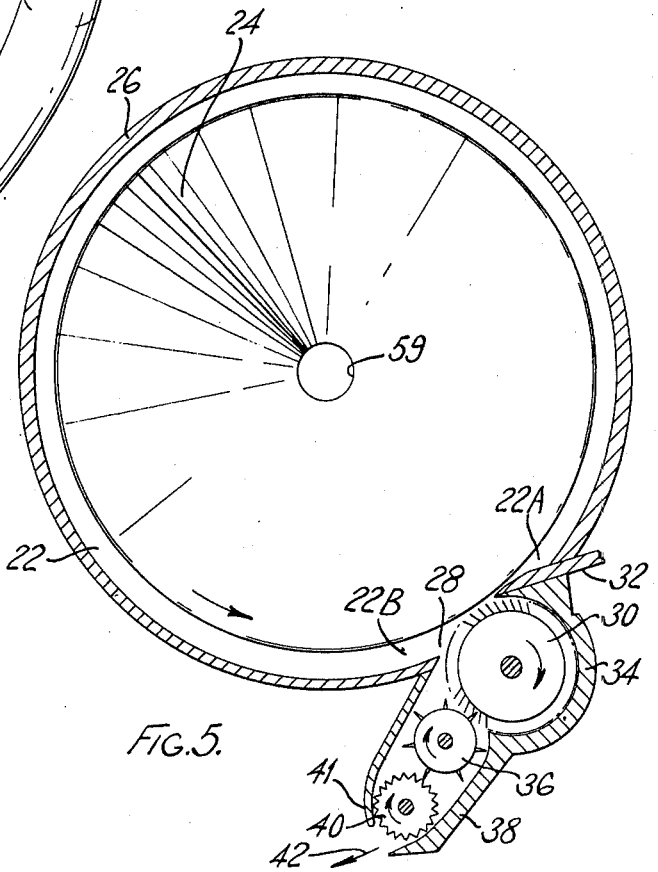
FIG. 5 is a section of the line V—V in FIG. 1, but on a larger scale.

To facilitate movement of the carpet of tobacco through the annular space between the drum and the surrounding member 26, the thickness of the annular space increases progressively in a counterclockwise direction as seen in FIG. 5. In other words, the radial dimension of the annular space increases progressively from the region 22A to the exit region 22B at which it is at a maximum. For example the radial thickness of the annular space at the end 22A may be 12 mm, while the thickness of the space at the end 22B is 15 mm, the diameter of the drum 24 being for example 370 mm.

The speed of rotation of the drum 24 may, for example, be 12 revolutions per minute.

It should be noted that the radial thickness of the gap between the carded roller 30 and the casing 34 is less than the thickness of the annular space 22 at the exit region 22B, being for example 8 to 9 mm. It is preferred that the thickness of the carpet on the carded roller should not be much greater than 8 to 9 mm. Accordingly, in order that the carpet on the roller 30 can have the required thickness but without an excessive density, the roller 30 has a peripheral speed which is somewhat greater (at least 20% greater) than that of the drum 24. For example, the peripheral speed of the roller 30 may be 330 mm/sec. compared with a drum peripheral speed of 250 mm/sec. The speed of the picker roller 36 in this case is about 1500 to 2000 rpm. The accelerator roller 40 speed may for example be 2000 rpm.

Above the carded roller 30 (see FIG. 1) there is a deflector 18A which intercepts the tobacco from the spreading device which is directed towards the roller 30 and scraper 32, and deflects this tobacco into the annular space 22, possibly with the aid of an air jet. The deflector may for example be so shaped as to deflect part of the tobacco downstream and part upstream of the roller and scraper; alternatively all the tobacco may be deflected into the annular space either downstream or upstream of the roller and scraper.

Figure 6:
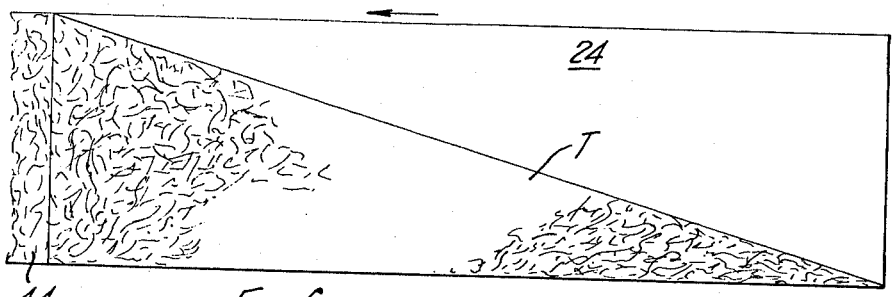
FIG. 6 is a flat developed view of the surface of the drum in FIG. 1.

FIG. 6 is a flat developed view of the surface of the drum 24 and shows how the tobacco T builds up in the annular space from zero height immediately downstream of the scraper 32 (i.e. at the right-hand end of FIG. 3) to the full height of the annular space at the opening 28 to form a carpet 44. The direction of motion is shown by the arrow.

To increase the driving friction between the drum 24 and the tobacco in the annular space, the surface of the drum may be made rough. In this case the scraper 32 may be omitted, and the tobacco carpet may be blown off the drum, which would for this purpose have an air-pervious outer wall so that air can blow through it from a localised source of compressed air in the drum in the region of the carded roller 30.

As shown in FIG. 1, the drum 24 may be driven by a shaft 46 via gear wheels 48 and 50, the gear wheel 50 being connected to the base 24A of the drum. The carded roller 30 is driven at the speed directly related to that of the drum via a timing belt 52 which passes round a pulley 54 on a shaft 56 connected to the carded roller 30, and around a pulley 58 connected to the base 24A of the drum.

The tobacco is preferably carried into the spreading device by air in a manner which will be described with reference to FIG. 7. Most of the air which conveys the tobacco towards the spreading device can be removed by means of an air separator, but some air passes into the spreading device with the tobacco; this air passes out of the drum through an outlet 59 leading to a pipe 60 via a rotatabe coupling 61, as seen in FIG. 1. Furthermore any tobacco which does not pass into the annular space 22 (for example, any momentary excess over the amount which can be received in the annular space) is carried out by the air through the pipe 60. It will be seen that the drum has a conical inner portion 24B to facilitate movement of tobacco smoothly into the outlet 59.

Radial passages 24C in the end wall 24A of the drum connect the outlet 59 to the lower end of the annular space 22 so that air is drawn from the annular space through the passages 24C; this flow of air equals (or slightly exceeds) the leakage air flow into the annular space between the end wall 24A and the member 26, thus preventing any air flow upwards through the annular space as a result of the leakage.

Figure 9:
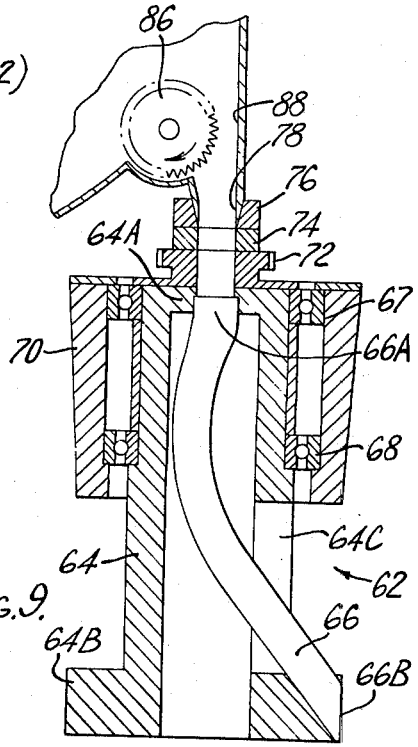
FIG. 9 is an enlarged view of the spreading device in the apparatus shown in FIG. 7.

FIG. 9 shows an example of a spreading device 62 which operates similarly to the spreading device 2 of FIG. 1 but is differently constructed. As shown in FIG. 9, the spreading device 62 consists of a sleeve part 64 with an internal flange 64A at one end and an external flange 64B at the other end. A pipe 66 forming the tobacco channel has its inlet end 66A secured to the flange 64A and passes through a slot 64C so as to reach a groove in the flange 64B in which the outlet end 66B of the pipe is secured. The outlet end portion of the pipe 66 is inclined backwards in relation to the rotation of the spreading device, as in the previous example. The shape of the pipe 66 is the same as that of the pipe 16' shown in FIGS. 3 and 4.

The spreading device 62 is carried by two ball bearings 67 and 68 within a fixed annular member 70. It should be noted that the spreading device in this example is not mounted in cantilever fashion from one end, as in FIG. 1.

As shown particularly in FIG. 9, secured to the upper end of the spreading device there is a gear wheel 72, by which the spreading device is rotated, a spacer ring 74, and a further ring member 76 which has a conical bore into which a conical stationary part 78 projects with a slight running clearance. During use the tobacco stream is carried by air through a delivery pipe 80 (see FIG. 7) which extends tangentially into an air separator 82 of which the part 78 serves as the outlet for tobacco. The tobacco is deflected towards the outlet 78 by a deflector 82A which forms one wall of the separator 82. The cross-section of the deflector changes progressively so as to narrow down the tobacco stream. Most of the air (for example 80% to 90%) which carries the tobacco into the air separator is drawn out through a pipe 84 and does not pass into the spreading device.

Figure 7:
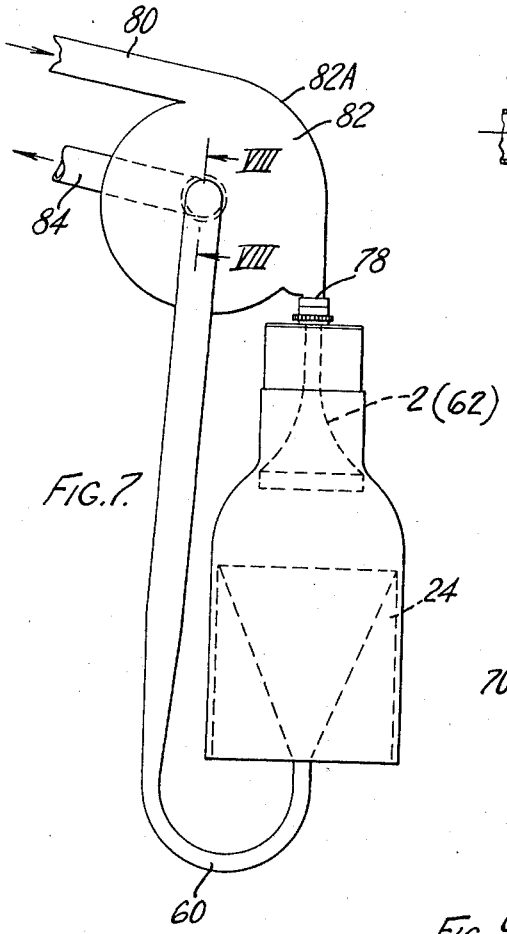
FIG. 7 is an elevational view of a different apparatus.
Figure 8:
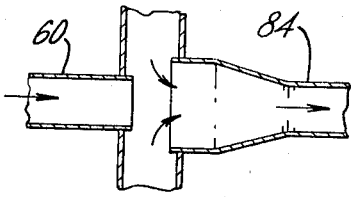
FIG. 8 is a section on the line VIII—VIII in FIG. 7.

As shown diagrammatically in FIG. 7, the pipe 60 leading from the bottom end of the drum 24 (which is the same as in FIG. 1) extends up to the axis of the separator 82. Thus, as shown in FIG. 8, the air returned by the pipe 60, together with any tobacco entrained in the air, passes straight through the separator and into the pipe 84 which returns to the primary unit (not shown) by which the tobacco is delivered by air into the pipe 80. The primary unit may for example include various mechanisms for separating and winnowing the tobacco.

In regard to FIG. 7 is should be noted that the tobacco which enters the separator 82 through the inlet 80 moves along the deflector 82A and then out through the outlet 78 without its velocity being significantly reduced. This is helped by the fact that some air flows out through the tobacco outlet 78. For this purpose the suction pressure in the spreading device (e.g. 75 mm water gauge) is preferably greater than that in the box 82 (e.g. 65 mm water gauge) though it may alternatively be slightly less since the dynamic head in the box 82 helps the air to pass out through the outlet 78. A knurled roller 86 rotates near the tobacco outlet part 78 so as to help in pushing the tobacco into the spreading device in the event that there is any tendency for tobacco to jam at the outlet of the separator.

The separator is shown in more detail in U.S. Pat. Application Ser. No. 275,800, filed July 27, 1972.

It will be understood that in the embodiment of FIG. 9 the members 74 and 76 rotate with the spreading device. The spacer ring 74 is replaceable so that a ring of different thickness can be used to enable the axial position of the spreading device to be varied slightly. For this purpose the position of the annular part 70 carrying the spreading device is axially adjustable.

If the apparatus shown in FIG. 7 is used in the upright position (as shown), the carpet of tobacco which it forms lies vertically and moves horizontally. In order to form the carpet into a cigarette filler stream, the carpet may for example be delivered to the filler forming device shown diagrammatically in FIG. 10. The device includes a 90° frusto-conical air-pervious drum 90 (i.e. with a 90° cone angle) which rotates with its axis at 45° to the horizontal. The carpet 92 is delivered to the vertical side of the drum and is held on the drum by suction in the drum. During 180° of rotation of the drum the carpet is reduced in width (for example, as described in U.S. Pat. No. 3,548,837 so as to form a narrow filler stream 94 at the top of the drum. This filler stream is carried away in the groove of a suction wheel 96 and is subsequently enclosed in a continuous web to form a cigarette rod.

Figure 11:
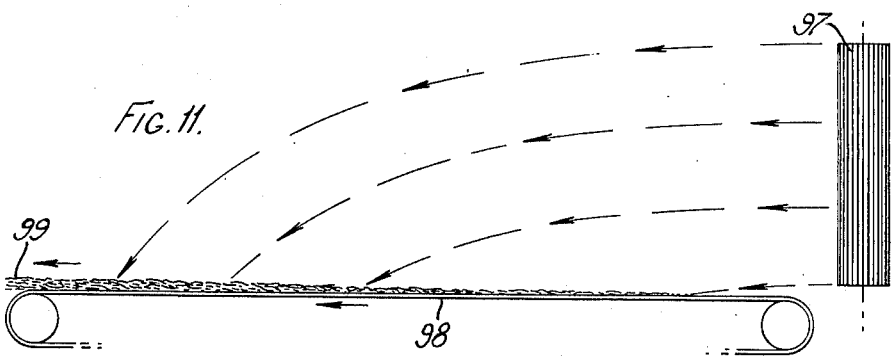
FIGS. 10 and 11 are elevational views of different machines for forming a cigarette filler stream from the carpet delivered by the apparatus of FIG. 1.

FIG. 11 shows an alternative way of forming a cigarette filler stream from the vertical carpet. In this example an accelerator roller 97 projects the tobacco horizontally, for example at a speed of 4.5 to 5 meters/sec., so that the tobacco falls down on to a band 98 to build up a filler stream 99. The band 98 may move at a speed of about 4.5 to 5 meters/sec., so it will be seen that the first tobacco to reach the band (i.e. from the lower end of the roller 97) has a forward component of velocity approximately equal to the speed of the band. In view of the shape of the tobacco trajectory, the shower tends to be more dense towards the downstream end of the band 98, but this effect is countered by the fact that the carpet itself tends to be less dense towards the top.

Another way of forming a cigarette filler stream from the vertical carpet is described in U.S. Pat. application Ser. No. 275,633, filed July 27, 1972.

Figure 10:
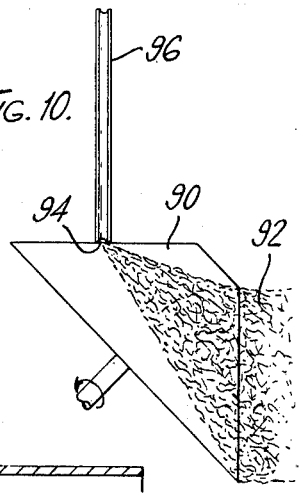

As an alternative to the arrangement shown in FIG. 10, the drum 90 could be cylindrical, with a vertical axis, and the transfer wheel could rotate about an axis inclined to the horizontal by 45° and with its periphral surface forming a 90° fruto-cone.

Figure 12:
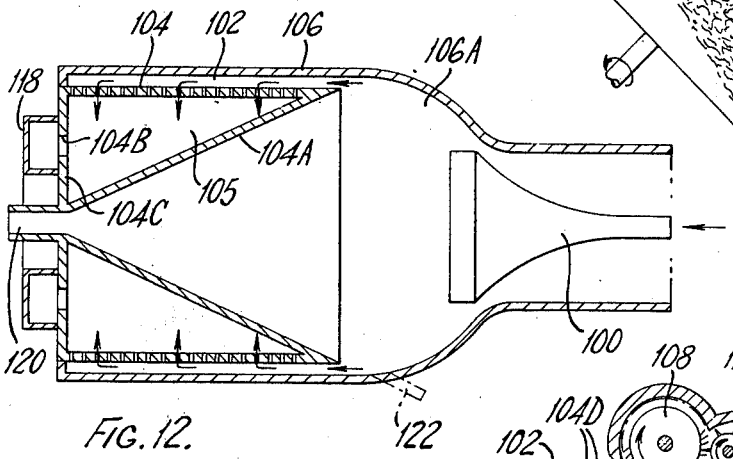
FIG. 12 is a view similar to FIG. 1 but showing a different machine.
Figure 13:
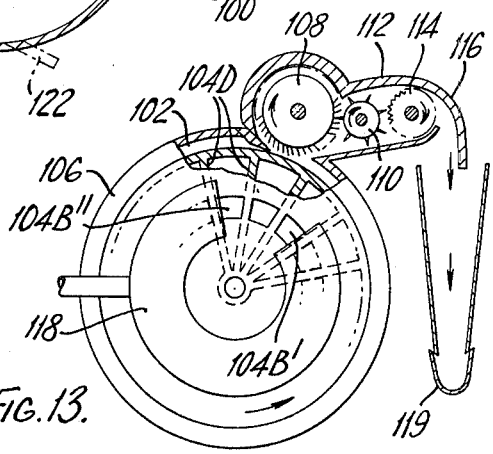
FIG. 13 is a partly sectioned end view as seen from the left in FIG. 12.

FIGS. 12 and 13 show part of an alternative form of carpet forming apparatus which is similar to that shown in FIGS. 1 and 2, excepting mainly that it has been turned through 90° so as to form a substantially horizontal carpet. Tobacco is thrown by a rotary spreading device 100 into an annular space 102 between a cylindrical drum 104 and a surrounding stationary casing 106. A carpet is thus built up in the space 102 and is removed by a carded roller 108 (FIG. 13). A picker roller 110 removes the carpet of tobacco from the roller 108 and projects the tobacco along a plate 112 which has a downwardly curved deflector portion 116 along which the tobacco is projected at a high speed by an accelerator roller 114. The tobacco is thus showered downwards into a trough formed by a horizontally moving band 119 (shown in cross-section in FIG. 13), so as to build up a cigarette filler stream.

The outer wall of the drum 104 is air pervious (for example, with a 25% open area) so that air can be drawn through it by means of suction in the space 105 between the outer wall and a conical inner wall 104A forming part of the drum. Thus air is drawn axially into the annular space 102, as shown by the arrows, and assists the entry of the tobacco into the annular space. Moreover the suction creates a clamping force to hold the tobacco carpet onto the drum as it builds up in the annular space; to promote this action the casing 106 may be made slightly air-pervious (e.g. by means of a pattern of small spaced apertures) so that a small quantity of air can pass radially inwards through it.

The suction in the drum space 105 is admitted through a series of ports 104B in the end wall 104C of the drum from a suction manifold 118. The suction pressure in the manifold 118 is greater than the suction pressure in the space 106A in the casing 106. For example, the suction pressure in the space 106A may be 75 mm water gauge, while the suction pressure admitted to the space 105 from the manifold may be 135 mm water gauge.

A fixed annular valve sleeve may be fitted in the drum (just within the cylindrical outer wall of the drum) to confine the air flow through the drum to an area corresponding to the shape of the built-up tobacco in the annular space 102, so that air passes through the drum only where it is needed to clamp that tobacco to the drum. The casing 106 may be air-pervious over a similar area and impervious elsewhere.

Between the ports 104B there are radial vanes 104D which divide the space 105 into a number of separate circumferentially spaced compartments; for convenience and clarity, the vanes are shown widely spaced apart, but in practice they would be much closer together, i.e. at smaller angular intervals. This enables the suction holding the carpet to the drum to be cut off as the carpet approaches the carded roller 108 by which it is removed from the drum. As shown in FIG. 13, the port 104B[1] will soon pass one end of the manifold 118, and will therefore soon stop receiving suction, while the port 104B[11] has just begun to receive suction after passing the carded roller 108. The port between those two ports (i.e. in alignment with the carded roller 108) may communicate with a separate small manifold (not shown) which is supplied with compressed air to blow the fully formed carpet off the drum.

As in the FIG. 7 example, the air which passes through the spreading device 100 is drawn off through a pipe 120. In this example, any tobacco which does not enter the annular space 102 may be conveyed mechanically to the pipe 120 by forming the inner surface of the conical wall 104A of the drum with a series of part-helical paddles (not shown), for example at a 30° helix angle, acting somewhat like a multi-start feed screw. One or more air inlets 122 may be situated, for example, just upstream of the carded roller 108 to blow inwards and to the left (FIG. 12) any tobacco which fails to enter the annular space 102, so that the air jet or jets carry the tobacco at least part of the way towards the outlet pipe 120, the remainder of the conveyance towards the pipe 120 being achieved for example, by mechanical means.

Figure 14:
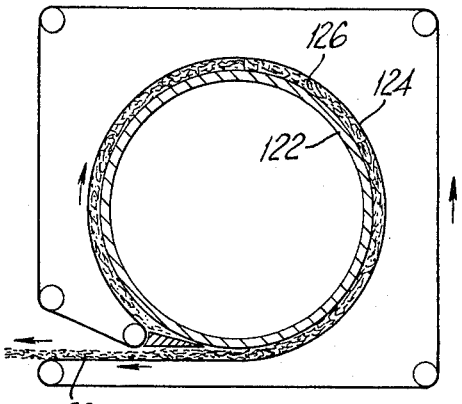
FIGS. 14 to 17 are respective elevational views of further embodiments of the present invention.

FIG. 14 shows in cross-section an alternative arrangement with a horizontal cyclindrical drum 122. Instead of the stationary casing round the drum, there is a band 124 so that the annular space 126 in which the tobacco carpet is built up is defined by the band and the drum. The band moves in the direction shown by the arrows and passes round various pulleys as shown. The drum may be stationary or it may rotate with a peripheral speed equal to the speed of the band. At the bottom of the drum a fully formed carpet 128 is conveyed by the band horizontally in a tangential direction from the drum. In the region where the band passes round the drum to define the annular space, it may be held to the required shape by means of suction supplied through a backing plate (not shown) extending round the band, so that suction holds the band to the backing plate.

Figure 15:
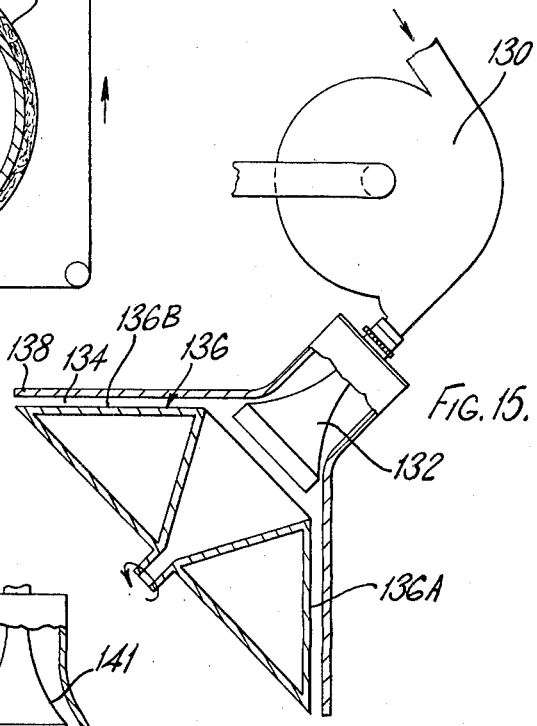

FIG. 15 shows a different example. Tobacco is delivered from an air separator 130 into a rotary spreading device 132 which has its axis of rotation at 45° to the horizontal. The spreading device throws the tobacco into an annular space 134 between a 90° frusto-conical drum 138 and a surrounding casing 136. This arrangement can be used to produce either a vertical carpet, delivered from the vertical side 136A of the drum, or a horizontal carpet delivered from the horizontal side 136B of the drum.

Figure 16:
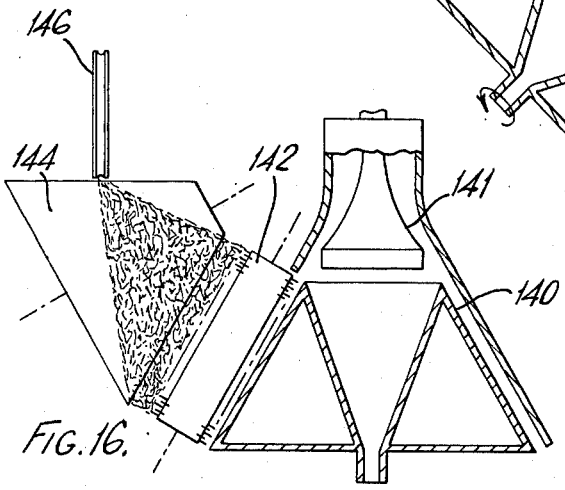

FIG. 16 shows a 60° frusto-conical drum 140 which rotates about a vertical axis and receives tobacco from a spreading device 141 to produce a carpet which is removed by a carded roller 142 and is projected, in a vertical plane and in a direction inclined upwards to the horizontal by 30°, on to an air-pervious drum 144. This drum carries the carpet upwards while progressively reducing its width, as in FIG. 10, so that the tobacco can be received in the groove of a suction wheel 146.

Figure 17:
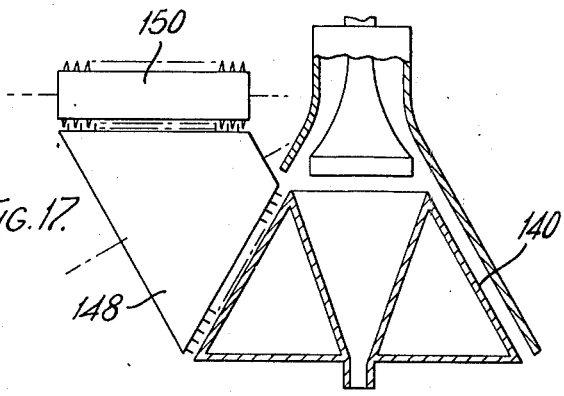

FIG. 17 shows a similar drum 140 from which the carpet is removed by a 60° frusto-conical carded roller 148. A picker roller 150 removes the tobacco from the roller 148, and the tobacco may then, for example, be showered on to a band to produce a cigarette filler stream.

In each example 6 to 9 Kilograms per minute of tobacco are fed to the separator by air flowing at a rate of 5500 to 7500 liters per minute.

I claim:

1. A cigarette filler forming apparatus for a cigarette making machine, comprising means for delivering a stream of tobacco particles; two cooperating members defining between them an annular space having a central axis, the annular space having a length, as seen in a plane containing the central axis, which is many times greater than its thickness, one of the cooperating members being movable about the central axis; means defining an outlet from the annular space having a length substantially equal to the length of the annular space; a spreading device arranged to receive the tobacco particles and to throw the particles into the annular space at positions substantially all the way around the central axis of the annular space to build up in the annular space a continuous carpet of tobacco, the width of the carpet, as seen in a plane containing said central axis, corresponding to the length of the annular space, the carpet being carried continuously by the moving member towards the outlet; means for feeding substantially the entire width of the carpet out through the outlet; and filler forming means arranged to receive said continuous carpet of tobacco for forming a cigarette filler therefrom, each section of the filler including tobacco particles obtained from various positions across substantially the entire width of the carpet.

2. Apparatus according to claim 1 wherein the width of said outlet is smaller than the thickness of said annular space.

3. Apparatus according to claim 1 wherein said means for feeding the carpet out through said outlet includes a carded roller driven so as to have a peripheral speed greater than the speed of movement of the carpet in said annular space.

4. Apparatus according to claim 1 wherein said two cooperating members comprise an inner rotatable member and an outer fixed casing disposed in spaced parallel relationship to said rotatable member.

5. Apparatus according to claim 1 in which the spreading device comprises means including a rotary member for producing a single rotating shower of tobacco particles on a continuous basis and having a narrow channel which has a tobacco inlet on the axis of rotation of the rotary member, for receiving a stream of tobacco particles, and an outlet spaced from the axis of rotation at the opposite end of the rotary member for directing the stream of particles in a predetermined direction relative to the rotary member, so that the stream of tobacco particles is delivered from the outlet end of the channel with a winding action, successive increments of the stream being delivered from the outlet end at successive positions spaced circumferentially around the axis of rotation of the rotary member providing a layering of tobacco in the annular space.

6. Apparatus according to claim 5 in which the outlet end portion of the channel of the spreading device is inclined towards the annular space, and including a fixed annular deflector which deflects the tobacco discharged from the spreading devices into the annular space.

7. Apparatus according to claim 5 in which the outlet end portion of the channel of the spreading device is inclined backwards with respect to a radial line at the outlet end, relative to the direction of movement of the outlet end, so that the tobacco particles leave the channel with substantially no circumferential component of motion.

8. Apparatus according to claim 5 in which the speed of rotation of the spreading device is several times greater than that of said one of the cooperating members.

9. Apparatus according to claim 8 in which the spreading device rotates at a speed of the order of 2000 rpm.

10. Apparatus according to claim 9 in which said one of the cooperating members rotates at a speed of the order of 12 rpm.

11. Apparatus according to claim 5 in which the tobacco is fed into the spreading device at a velocity of the order of 21 meters/sec.

12. Apparatus as defined in claim 5 wherein said rotary member is a body of revolution and said narrow channel is formed by an elongated narrow opening in the side surface of said body.

13. Apparatus as defined in claim 5 wherein said narrow channel in said rotary member is formed by a pipe extending from said tobacco inlet to said outlet.

14. Apparatus according to claim 1 including pneumatic means for feeding the tobacco into the spreading device.

15. Apparatus according to claim 14 including an air separator having a tobacco outlet for delivering tobacco to the inlet of the spreading device, the air separator comprising an inlet for air and tobacco, a deflector which deflects the tobacco towards the tobacco outlet, and an air outlet through which part of the air entering the air separator is discharged, leaving the remainder of the air to pass out through the tobacco outlet of the separator and into the spreading device.

16. A cigarette filler forming apparatus for a cigarette making machine, comprising means for delivering a stream of tobacco particles; a rotary drum and a stationary member surrounding said rotary drum defining between them an annular space having a central axis, the annular space having a length, as seen in a plane containing the central axis, which is many times greater than its thickness, means defining an outlet from the annular space; a spreading device arranged to receive the tobacco particles and to throw the particles into the annular space at positions substantially all the way around the central axis of the annular space to build up in the annular space a continuous carpet of tobacco, the width of the carpet, as seen in a plane containing the central axis, corresponding to the length of the annular space, the carpet being carried continuously by the rotary drum towards the outlet; means for feeding said carpet out through the outlet; and filler forming means arranged to form a cigarette filler from the continuous carpet of tobacco, each section of the filler including tobacco particles obtained from various positions across the width of the carpet.

17. Apparatus as defined in claim 16 wherein said means for feeding said carpet out through the outlet includes scraper means for directing substantially the entire carpet out through the outlet.

18. A cigarette filler forming apparatus for a cigarette making machine, comprising means for delivering a stream of tobacco particles; two cooperating members defining between them an annular space having a central axis, the annular space having a length, as seen in a plane containing the central axis, which is many times greater than its thickness, one of the cooperating members being movable about the central axis; means defining an outlet from the annular space; a spreading device arranged to receive the tobacco particles and to throw the particles into the annular space at positions substantially all the way around the central axis of the annular space to build up in the annular space a continuous carpet of tobacco, the width of the carpet, as seen in a plane containing said central axis, corresponding to the length of the annular space, the carpet being carried continuously by the moving member towards the outlet; a carded roller arranged to feed the tobacco carpet formed in the annular space through the outlet in a direction which is substantially tangential in relation to the annular space; and filler forming means arranged to form a cigarette filler from the continuous carpet of tobacco, each section of the filler including tobacco particles obtained from various positions across the width of the carpet.

19. Apparatus as defined in claim 18 wherein said carded roller extends substantially across the length of the annular space.

20. Apparatus according to claim 18 further including means for driving said carded roller so as to have a peripheral speed greater than the speed of movement of the carpet in said annular space.

21. Apparatus according to claim 18 wherein said carded roller is spaced from said one of the cooperating members by a distance less than the thickness of a portion of the annular space adjacent to the said carded roller.

22. A cigarette filler forming apparatus for a cigarette making machine, comprising means for delivering a stream of tobacco particles; two cooperating members defining between them an annular space having a central axis, the annular space having a length, as seen in a plane containing the central axis, which is many times greater than its thickness, one of the cooperating members being movable about the central axis and the two cooperating members being arranged relative to one another so that the thickness of the annular space increases progressively in the direction of movment of the carpet; means defining an outlet from the annular space; a spreading device arranged to receive the tobacco particles and to throw the particles into the annular space at positions substantially all the way around the central axis of the annular space to build up in the annular space a continuous carpet of tobacco, the width of the carpet, as seen in a plane containing said central axis, corresponding to the length of the annular space, the carpet being carried continuously by the moving member toward the outlet; and filler forming means arranged to form a cigarette filler from the continuous carpet of tobacco derived from said outlet, each section of the filler including tobacco particles obtained from various positions across the width of the carpet.

23. A spreading device for delivering particles of tobacco into an annular space, comprising means including a rotary member for producing a single rotating shower of tobacco particles on a continuous basis and having a narrow channel which has a tobacco inlet end on the axis of rotation of the rotary member, for receiving a stream of tobacco particles, and an outlet end spaced from the axis of rotation for directing the stream of particles in a predetermined direction relative to the rotary member, so that the stream of tobacco particles is delivered from the outlet end of the channel with a winding action, successive increments of the stream being delivered from the outlet end at successive positions spaced circumferentially around the axis of rotation of the rotary member providing a layering of tobacco in the annular space.

24. Apparatus as defined in claim 23 wherein said rotary member is a body of revolution and said narrow channel is formed by an elongated narrow opening in the side surface of said body.

25. Apparatus as defined in claim 23 wherein said narrow channel in said rotary member is formed by a pipe extending from said tobacco inlet to said outlet.

26. A spreading device for delivering particles of tobacco into an annular space, comprising a rotary member including means defining a channel which has a tobacco inlet end on the axis of rotation of the rotary member, for receiving a stream of tobacco particles, and an outlet end spaced from the axis of rotation, so that the stream of tobacco particles is delivered from the outlet end of the channel with a winding action, successive increments of the stream being delivered from the outlet end at successive positions spaced circumferentially around the axis of rotation of the rotary member, the outlet end portion of the channel being inclined backwards with respect to a radial line at the outlet end, in relation to the direction of movement of the outlet end, so that the tobacco particles leave the channel with substantially no circumferential component of motion.

27. Apparatus for forming a tobacco stream, comprising means defining an annular space having a central axis, a rotary spreading device which has its axis of rotation in line with said central axis of the annular space and delivers tobacco into the annular space so as to build up a circumferentially extending tobacco stream in the annular space, said spreading device comprising means including a rotary member for producing a single rotating shower of tobacco particles on a continuous basis and having a narrow channel which has a tobacco inlet end on the axis of rotation of the rotary member, for receiving a stream of tobacco particles, and an outlet end spaced from the axis of rotation for directing the stream of particles in a predetermined direction relative to the rotary member, so that the stream of tobacco particles is delivered from the outlet end of the channel with a winding action, successive increments of the stream being delivered from the outlet end at successive positions spaced circumferentially around the axis of rotation of the rotary member providing a layering of tobacco in the annular space, and means for continuously feeding the tobacco stream out of the annular space.

28. Apparatus as defined in claim 27 wherein said rotary member is a body of revolution and said narrow channel is formed by an elongated narrow opening in the side surface of said body.

29. Apparatus as defined in claim 27 wherein said narrow channel in said rotary member is formed by a pipe extending from said tobacco inlet to said outlet.

30. Apparatus for forming a tobacco stream, comprising an air separator a pipe leading to the air separator, means for delivering tobacco by means of air into the pipe and thence into the air separator, the air separator being arranged to remove part of the air and to pass out the tobacco without significantly reducing its velocity, and a tobacco spreading device including a rotary member for producing a single rotating shower of tobacco particles, said rotary member receiving the tobacco from the air separator, an annular space defined by at least one moving part and one stationary part disposed adjacent said spreading device so that a tobacco stream is built up in the annular space and is carried towards an outlet through which at least part of the built-up tobacco stream is continuously removed.

31. A method of making cigarettes in which a carpet of tobacco is formed into a cigarette filler stream, characterized by spreading tobacco in a single stream around an annular space having a peripheral width many times greater than its thickness to build up a carpet in the annular space, and continuously feeding substantially the entire built-up carpet out of the annular space.

32. In a cigarette making machine, a carpet forming apparatus comprising a rotary drum, a surrounding casing defining with the drum an annular space, a rotary spreading device coaxial with the drum and arranged to be driven at a speed several times greater than that of the drum and having means defining at least one channel providing a predetermined path through which tobacco passes through the spreading device, means for supplying tobacco to the spreading device, and means for feeding from the annular space a tobacco carpet having a width corresponding to the axial height of the annular space, the carpet which is fed from the annular space being built up from the tobacco delivered into the annular space by the spreading device and having a thickness considerably greater than its width.

33. Apparatus according to claim 32 including means defining an outlet through which the tobacco carpet is delivered from the annular space, the thickness of said outlet being smaller than the thickness of said annular space.

34. Apparatus according to claim 32 wherein said means for feeding the carpet out through said outlet includes a carded roller driven so as to have a peripheral speed greater than the speed of movement of the carpet in said annular space.

35. Apparatus as defined in claim 32 wherein said rotary spreading device is a body of revolution and said channel is formed by an elongated narrow opening in the side surface of said body extending from a tobacco inlet on the axis of rotation of said body to an outlet spaced from said axis.

36. In a cigarette filler forming apparatus, the combination of a rotary drum and a surrounding fixed casing defining an annular space, an annular deflector, coaxial with the annular space, for deflecting tobacco axially into the annular space, means for supplying a stream of tobacco, and spreading means for delivering tobacco received from said tobacco supply means onto the deflector, the spreading means comprising a rotary member for producing a single rotating shower of tobacco particles on a continuous basis including means defining a narrow channel having a tobacco inlet end on the axis of rotation of the rotary member for receiving a stream of tobacco particles, and an outlet end spaced from the axis of rotation for directing the stream of particles in a predetermined direction relative to the rotary member, whereby the tobacco stream is delivered from the outlet end of the channel of the spreading device and towards the deflector with a winding action, successive increments of the stream being delivered from the outlet end at successive positions spaced circumferentially around the axis of rotation of the rotary member providing a layering of tobacco in the annular space.

37. Apparatus as defined in claim 36 wherein said rotary member is a body of revolution and said narrow channel is formed by an elongated narrow opening in the side surface of said body.

38. Apparatus as defined in claim 36 wherein said narrow channel in said rotary member is formed by a pipe extending from said tobacco inlet to said outlet.

39. A cigarette making machine comprising means for feeding a stream of winnowed particles of tobacco pneumatically in a pipe; inner and outer substantially coaxial members defining between them an annular space having a central axis and a length, as seen in a plane containing the central axis, which is many times greater than its thickness, the inner member being rotatable about its axis; means defining an outlet from the annular space; means for receiving the stream of tobacco particles from the pipe and for feeding the particles into the annular space, at various positions about the axis of the coaxial members and in a direction which is substantially axial in relation to the said members to build up in the annular space a continuous carpet; means for feeding substantially the entire carpet continuously out of the annular space; and filler forming means arranged to form a cigarette filler from the continuous carpet, each section of the filler including tobacco particles obtained from various positions across substantially the entire width of the carpet.

40. Tobacco feeding apparatus comprising means for delivering a first high-speed stream of tobacco particles; means defining an annular space having an outlet at one location along its circumference, the annular space being defined partly by a moving member which moves about the axis of the annular space at a predetermined speed; a rotary member which is substantially coaxial with the annular space for producing a single rotating second stream of tobacco particles on a continuous basis and includes a narrow channel which has an inlet on the axis of rotation of the rotary member, and an outlet which is spaced from the said axis of rotation; and means for directing the first stream of tobacco particles axially into the said channel inlet; the second stream of tobacco particles being delivered from the channel outlet, in a predetermined direction relative to the rotary member, and entering into the annular space to build up a carpet of tobacco particles in the annular space, the carpet being fed continuously towards the outlet from the annular space by the said moving member; the speed of rotation of the rotary member being substantially greater than the speed at which the moving member moves about the axis of the annular space, whereby the carpet as it arrives at the outlet from the annular space is composed of a plurality of layers formed by the tobacco delivered into the annular space by the rotary member during several successive revolutions of the rotary member.

41. Apparatus as defined in claim 40 wherein said rotary member is a body of revolution and said narrow channel is formed by an elongated narrow opening in the side surface of said body.

42. Apparatus as defined in claim 40 wherein said narrow channel in said rotary member is formed by a pipe extending from said tobacco inlet to said outlet.

* * * * *